US005725390A

United States Patent [19]

Watts

[11] Patent Number: 5,725,390

[45] Date of Patent: Mar. 10, 1998

[54] ELECTRICAL SPLICE BOX

[76] Inventor: Edward Francis Watts, 5320 Maple View Cir., Camarillo, Calif. 93012

[21] Appl. No.: 749,406

[22] Filed: Nov. 13, 1996

[51] Int. Cl.[6] ..... H01R 4/24

[52] U.S. Cl. ..... 439/410; 439/425

[58] Field of Search ..... 439/410, 417, 439/418, 409, 422, 425

[56] References Cited

U.S. PATENT DOCUMENTS

| | | | |
|---|---|---|---|
| 4,370,015 | 1/1983 | Hutter et al. | 439/425 |
| 4,461,528 | 7/1984 | Durand et al. | 439/417 |
| 4,834,672 | 5/1989 | Michely | 439/425 |
| 5,498,172 | 3/1996 | Noda | 439/417 |

FOREIGN PATENT DOCUMENTS

| | | | |
|---|---|---|---|
| 3340943 | 5/1985 | Germany | 439/425 |

*Primary Examiner*—Gary F. Paumen

*Assistant Examiner*—Tho D. Ta

*Attorney, Agent, or Firm*—Marvin E. Jacobs

[57] ABSTRACT

An electrical connector for interconnecting a pair of three-wire parallel conductor cables of the ROMEX variety. The novel connector comprises a bottom member and hinged cover made from insulating material. The bottom member has a trough having connecting blades on opposing sides and a grounding spike extending from the trough base. The cover has a grounding spear facing the trough base grounding spike when the cover is in the closed position. The grounding spike and spear are conductively connected to one another establishing a quick and easy electrical splice between load, neutral and ground conductors of both cables.

16 Claims, 2 Drawing Sheets

ELECTRICAL SPLICE BOX

TECHNICAL FIELD

The invention relates to electrical connectors and, more specifically, to electrical connectors which splice together a pair of three-conductor parallel flat cables without stripping the insulation about any wire.

BACKGROUND OF THE INVENTION

Parallel flat three conductor cables, often referred to by the trademark ROMEX cables, have found widespread use among contractors in the building industry. These cables are flexible, easy to use and have become the preferred choice for electrically wiring a residential house.

The usual practice in the building industry has been to use one side conductor as the load or positive wire; the middle conductor as the ground and the other side conductor as the neutral.

Situations may occur, either during initial installation or subsequent remodeling work, where it becomes necessary to splice a second three conductor cable to the main cable. The following are examples where splicing would be necessary: the initial installation requires the main conductor cable to be extended by splicing an extension conductor cable or, subsequent to the initial installation, it becomes necessary to provide wiring for another electrical device to be connected such as a ceiling fan, air conditioner or the like, where a branch conductor cable is spliced to the main conductor cable.

The prior art has many examples of connectors used to conductively splice conductor cables. Typical among the prior art is U.S. Pat. No. 4,461,528 issued to Durand et al. The Durand et al. patent provided a connector for joining two conductors by providing a base having separate cradles for each and a hinged cover having a connecting blade for piercing the insulation of each conductor when the cover is pivoted into the closed position. Duran et al. is ideal for connecting single wire conductors but is not suitable for, nor does it teach a connector to readily connect multiple wire cables.

U.S. Pat. No. 5,498,172 issued to Noda provides a device for interconnecting parallel multiple conductor cables. Although Noda was designed for signal transmission systems which tend to be thin gage wiring, the concept could be used for splicing flat conductor cables. However, Noda teaches a connector having a middle cable receiving section and a pair of outer covers with one conductor cable disposed between each cover and cable receiving section. The receiving section in Noda increases the complexity of splicing conductors in view of the simplistic arrangement of the present invention.

STATEMENT OF THE INVENTION

The present invention provides for an electrical connector for conductively connecting three-wire parallel insulated conductor cables which are similar to and often described as the trademark ROMEX cable.

The novel connector is comprised of a base and a top cover hinged to one another. Both base and cover are made from an insulating electrical material such as plastic.

The connector is configured in a substantially rectangular shape. The connector base comprises a trough having opposing side walls and a bottom wall. Additionally, a conductor spike extends upward, into the trough from the bottom wall, parallel in direction to the side walls.

Preferably, the depth of the trough is sufficient to receive two flat, parallel conductor cables positioned one on top of the other. Both conductor cables are disposed within the trough when assembly of the cables to the connector is complete.

The width of the trough, defined as the distance between the side walls, is slightly greater than the width of the conductor cables which will be positioned within. The appropriate width assures a snug fit of each cable to the connector, but more importantly, the proper width correctly positions both cables in the trough.

The conductor spike further is positioned substantially equidistant from each side wall and is of sufficient length, rigidity and sharpness to pierce the conductor insulation and make contact with the center or ground wire of the lower conductor cable as will be discussed later. Each side wall has a connecting blade extending into the trough and transverse to the bottom wall. Each blade is secured to its respective side wall by conventional means known to one skilled in the art. The cutting surface of each blade extends into the trough a sufficient distance to make contact with the adjacent side wire of both conductor cables disposed within the trough as will be discussed later.

The top cover has a conductor spear extending away from the bottom side of the cover. When the cover is in the closed position over the trough, the spear extends into the trough. The spear does not necessarily have to be aligned with the base spike. However, when the cover is in the closed position, the spear must be of sufficient length, rigidity and sharpness to pierce the conductor and make contact with the center or ground wire of the upper conductor cable.

Additionally, the cover spear is electrically connected to the base spike by a conductive wire, preferably insulated.

The positioning of the hinge relative to the cable direction through the connector is of no particular significance. The hinge member may be positioned near either trough end or, more preferably, located transverse to the cable direction and mounted on the side of the base.

The novel connector can be utilized to join the ends of flat conductor cables together and thus serve as a cable extension means. Alternatively, the invention may be utilized to connect a branch electrical cable to a main conductor cable along any portion of its length.

Having described the present invention, the procedure for splicing a pair of three-conductor parallel flat cables would be as follows. The connector is initially in the open position where the top cover is pivoted away from the base. The lower cable, preferably the main conductor cable, is first positioned in the connector trough. The lower cable is disposed into the trough of the receiving base such that the respective blades extending into the trough from each side wall pierce the insulation and make electrical contact with a respective side conductor. Sufficient downward force is applied to displace the conductor further into the connector trough until the tip of the base spike is in contact with the insulation protecting the center conductor of the lower cable. The downward force is continued until the base spike penetrates the protective insulation and makes electrical contact with the center conductor and, as a result, the lower cable is resting on the surface of the bottom wall.

Next, the upper conductor cable, which is preferably the branch or extension conductor cable, is positioned in the connector trough directly above the lower conductor cable. Again, sufficient force is applied so that the respective blades extending from each side wall which have already pierced the lower cable will also pierce the insulation and make electrical contact with the adjacent respective side conductor of the upper cable.

At this stage, both conductor blades in the connector trough are in electrical contact with adjacent conductors from a respective side of both conductor cables. Typically, installers of three-conductor parallel flat cables have one side conductor being positive and the other side being neutral. The positive and neutral conductors of both cables would now be in electrical contact with one another.

The middle conductor of the second cable is conductively connected to the middle conductor of the lower cable by pivoting the top cover into the closed position over the connector trough. As this is done, the cover spear will make contact with the insulation protecting the center conductor of the upper cable. As sufficient force is applied to close the cover, the cover spear will pierce the insulation and penetrate sufficiently to make conductive contact with the middle conductor.

Either or both cover spear and base spike may have a serrated configuration which would tend to resist detachment from the wire penetrated by same.

A locking means may be provided. Such a means may be a snap fit variety on the side of the cover opposite the hinged side. Alternatively, a fastening means may be employed on the hinge itself to prevent pivoting of the cover once in closed position. Any other fastening means known in the art may be utilized to maintain base and cover in a closed and locked position.

An alternative embodiment of the invention would not incorporate the use of a hinge between base and cover. This embodiment would employ a locking mechanism and preferably one on opposite sides of the connector.

Preferably, the invention should be of a sufficient length so that the spliced end of the upper cable remains within the connector so that a conductor end is not exposed outside of the connector.

Another alternative embodiment of the invention has one side of the top cover having an extending ear which extends either into the trough or partially covering the entrance into the trough at one end. The length of the ear is sufficient to block entrance into the trough on one side except for the base or first conductor cable. The ear serves to prevent exposure of the end of the second cable outside of the connector.

Numerous benefits are realized with this novel electrical connector. The invention is simple in concept, design and application. The design permits quick connection between a main conductor cable and a branch conductor cable each having three, flat parallel insulated wires. The housing can be made from molded plastic which provides for a low-cost manufactured unit.

These and many other features and attendant advantages of the invention will become apparent as the invention becomes better understood by reference to the following detailed description when considered in conjunction with the accompanying drawings.

DETAILED DESCRIPTION OF THE PREFERRED EMBODIMENT

Figure 1:
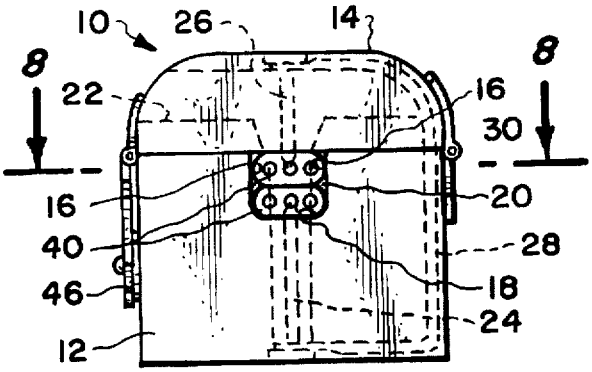
FIG. 1 is an end view of the invention having two ROMEX style flat cables disposed within the trough of the base.
Figure 2:
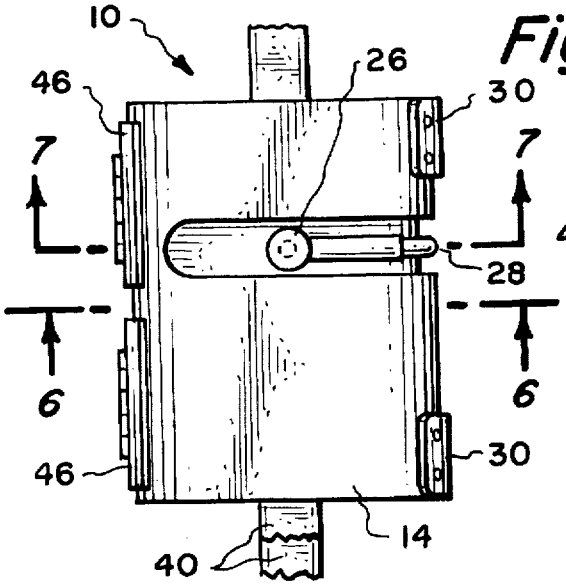
FIG. 2 is a top view of the invention in the closed position.
Figure 3:
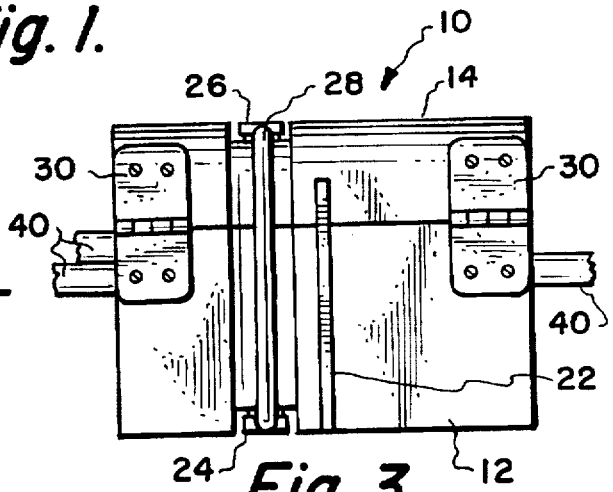
FIG. 3 is a side view of the invention in the closed position.
Figure 4:
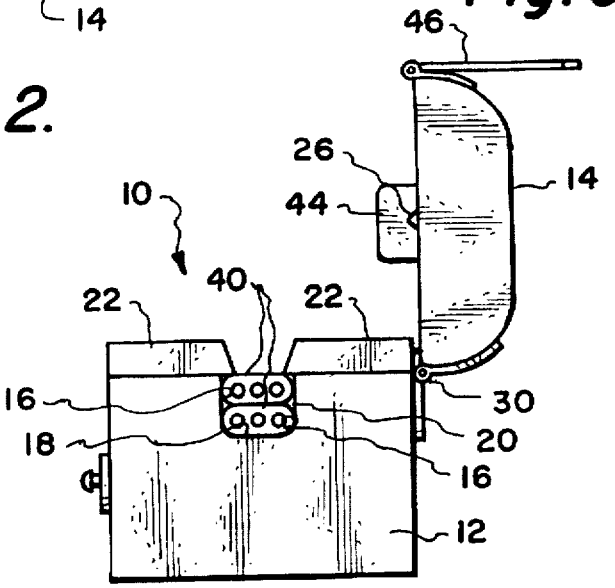
FIG. 4 details the cover ear in relation to the base when the connector is in the open and closed positions.
Figure 5:
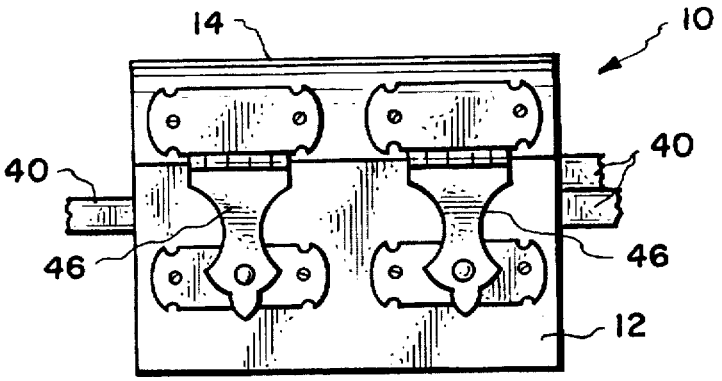
FIG. 5 is a front view of the invention depicting a pair of locking means.
Figure 6:
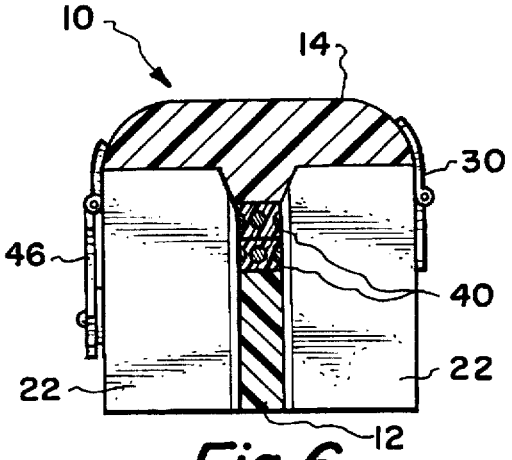
FIG. 6 is a cross section taken on line 6—6 of FIG. 2.
Figure 7:
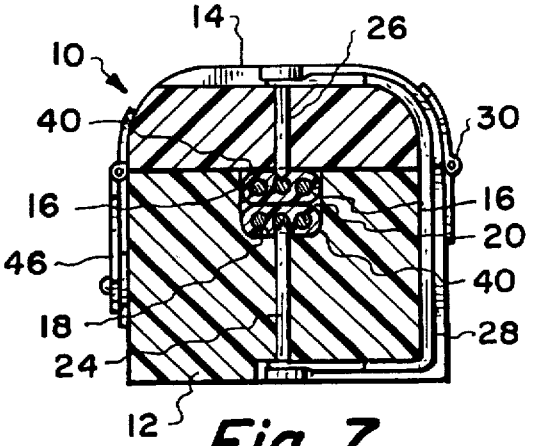
FIG. 7 is a cross section taken on line 7—7 of FIG. 2.
Figure 8:
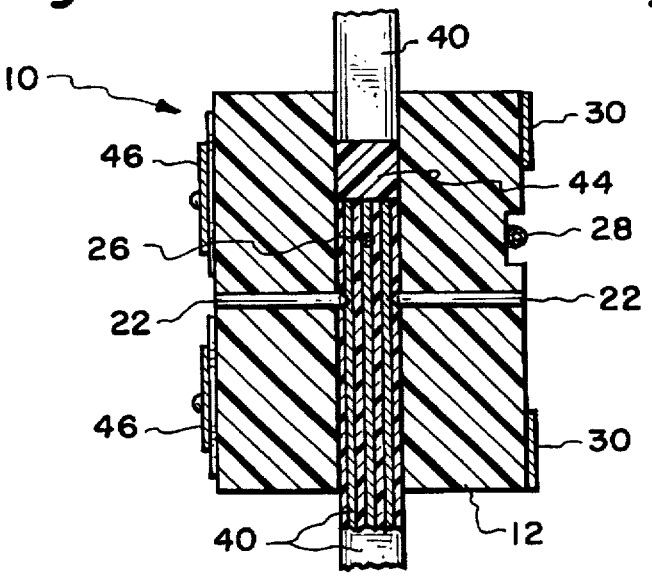
FIG. 8 is a cross section taken on line 8—8 of FIG. 1.

The novel connector 10 is illustrated in FIG. 1 in the final assembled configuration where two parallel flat three-conductor cables 40 are conductively connected. Receiving base 12 and top cover 14 are made of an insulating electrical material. Hinge 30 allows top cover 14 to pivot between an open and closed position relative to receiving base 12.

Receiving base 12 has a pair of opposed side walls 16 extending parallel from base wall 18. The space between base wall 18 and side walls 16 define a trough 20. A connecting blade 22 is secured within each side wall 16 and extends into trough 20, transverse to base wall 18. A conductive base spike 24 extends from base wall 18 and into trough 20. Base spike 24 is parallel to and generally equidistant from each side wall 16. The width and depth of trough 20 is sized to a particular gage of conductor cable so that the width of trough 20 is only slightly wider than the outside width of conductor cable 40.

Initially, connector 10 is in the open position where top cover 14 is pivoted away and distal from receiving base 12. Preferably the main cable is inserted into trough 20 prior to the insertion of the branch or extension cable. As the main cable is inserted, the insulated sides will initially come into contact with connecting blades 22. As downward force is applied, connecting blades 22 begin to cut into the insulation of the main cable eventually contacting a respective side wire of the conductor cable. As downward force is continued, the insulation about the middle wire of the main cable contacts base spike 24. Continued downward force on the main cable eventually causes base spike 24 to pierce the insulation and penetrate into the cable a sufficient distance so that conductive contact with the middle wire occurs.

At this stage of the splicing procedure, all wires of the main cable are either in contact with a connecting blade 22 or base spike 24.

With the main conductor cable connected to the connector 10, the branch or extension cable is now positioned over the main cable in trough 20. As with installing the main conductor cable, downward force is applied so that connecting blades 22 cut into the insulation of the branch cable eventually contacting a respective side wire of the branch cable. Both side wires of the branch cable are in conductive contact with the adjacent side wire of the main conductor cable by a respective connecting blade 22.

Cover 14 has a conductive spear 26 extending from its bottom side. Cover spear 26 is conductively connected to base spike 24 by an insulated wire 28. As cover 14 is pivoted into the closed position, cover spear 26 will contact with the insulation protecting the middle wire of the branch cable. As sufficient force is applied to close cover 14 over receiving base 12, cover spear 26 will pierce the insulation and penetrate sufficiently to make electrical contact with the middle wire of the branch cable.

All wires of the branch cable are now in conductive contact with a corresponding wire from the main cable.

An ear 44 extends from the cover on one side. Ear 44, when the cover is in the closed position, either extends into trough 20 or, alternatively, partially covers the entrance to one side of trough 20. The purpose of ear 44 is to permit complete passage of the lower cable through trough 20 while blocking passage of the upper cable on one side of trough 20. Ear 44 thus serves as a barrier to protect the end of the upper cable from unintentional contact with foreign material outside of connector 10 which may cause an undesired short.

A locking mechanism 46 is utilized on the side of connector 10 opposite hinge 30 to insure base 12 and cover 14 remain in the closed position.

Other modifications will become apparent to those skilled in the art which do not depart from the spirit and scope of this invention as defined by the appended claims.

I claim:

1. An electrical connector comprising:

a receiving base comprising electrically insulating material, said base having a pair of opposing side walls and a bottom wall connected thereto, said walls defining a trough therebetween, said bottom wall further having an electrically conductive base spike extending into said trough parallel to said side walls, said base spike further being generally equidistant from said side walls;

a top cover comprising electrically insulating material, said cover having a conductive spear extending from the bottom of said cover;

each of said side walls having a connecting blade member extending an equivalent distance into said trough; and a means to electrically connect said base spike to said cover spear.

2. An electrical connector as recited in claim 1, wherein said electrically insulated material is comprised of molded plastic.

3. An electrical connector as recited in claim 1, wherein said electrical connecting means comprises a conductive wire.

4. An electrical connector as recited in claim 1, further comprising a means to lock said top cover to said receiving base when said top cover is positioned over said base and having said cover spear extending into said trough.

5. An electrical connector as recited in claim 1, further comprising a hinge pivotally connecting said top cover to said receiving base between an open position and a closed position.

6. An electrical connector as recited in claim 5, further comprising a means to lock said top cover to said receiving base when said top cover is pivoted into said closed position.

7. An electrical connector as recited in claim, 5, wherein said electrical connecting means comprises a conductive wire.

8. An electrical connector comprising:

a receiving base molded of electrically insulating material, said base having a pair of opposing side walls and a bottom wall connected thereto, said walls defining a trough therebetween space between said side walls and said bottom wall defining a, said bottom wall further having an electrically conductive base spike extending into said trough parallel to said side walls, said base spike further being generally equidistant from said side walls;

a top cover molded of electrically insulating material, said cover having a conductive spear extending from the bottom of said cover;

each of said side walls having a connecting blade member extending an equivalent distance into said trough; and a means to electrically connect said base spike to said cover spear.

9. An electrical connector as recited in claim 8, wherein said electrical connecting means comprises a conductive wire.

10. An electrical connector as recited in claim 8, further comprising a means to lock said top cover to said receiving base when said top cover is positioned over said base and having said cover spear extending into said trough.

11. An electrical connector as recited in claim 8, further comprising a hinge pivotally connecting said top cover to said receiving base between an open position and a closed position.

12. An electrical connector as recited in claim 11, further comprising a means to lock said top cover to said receiving base when said top cover is pivoted into said closed position.

13. An electrical connector as recited in claim 11, wherein said electrical connecting means comprises a conductive wire.

14. An electrical connector comprising:

a receiving base molded of electrically insulating material, said base having a pair of opposing side walls and a bottom wall connected thereto, said walls defining a trough therebetween, said bottom wall further having an electrically conductive base spike extending into said trough parallel to said side walls, said base spike further being generally equidistant from said side walls;

a top cover molded of electrically insulating material, said cover pivotally hinged to said receiving base between an open position and a closed position, said cover further having a conductive spear extending from the bottom of said cover;

each of said side walls having a connecting blade member extending an equivalent distance into said trough; and a conductive wire electrically connecting said base spike to said cover spear.

15. An electrical connector as recited in claim 14, further comprising a means to lock said top cover to said receiving base when said top cover is pivoted into the closed position.

16. An electrical connector for electrically splicing a pair of three-conductor parallel insulated flat cables comprising:

an insulated housing having a base and cover, the pair of flat cables disposed between said cover and said base, the facing surfaces of each cable in contact with one another, a first connecting blade provided for penetrating the insulation of the adjacent flat cables and contacting the respective adjacent conductor of each cable, a second connecting blade provided for penetrating the insulation of the adjacent flat cables and contacting the respective adjacent conductor of each cable on the side opposite from said first connecting blade, a pair of connecting spears, the first spear provided to penetrate and contact the middle conductor of one cable and the second spear provided to penetrate and contact the middle conductor of the second cable, and said pair of connecting spears being electrically connected to one another by an electrically conductive wire.

* * * * *